US007651186B2

(12) United States Patent
Yoshida et al.

(10) Patent No.: US 7,651,186 B2
(45) Date of Patent: Jan. 26, 2010

(54) METHOD OF CONTROLLING INK JET RECORDING APPARATUS

(75) Inventors: Yasunari Yoshida, Aichi-ken (JP); Hirotoshi Maehira, Nagoya (JP); Shinya Kato, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 257 days.

(21) Appl. No.: 11/702,641

(22) Filed: Feb. 6, 2007

(65) Prior Publication Data

US 2007/0182770 A1 Aug. 9, 2007

(30) Foreign Application Priority Data

Feb. 6, 2006 (JP) ..... 2006-027903

(51) Int. Cl.
*B41J 29/38* (2006.01)

(52) U.S. Cl. ..... 347/14

(58) Field of Classification Search ..... 347/14
See application file for complete search history.

(56) References Cited

U.S. PATENT DOCUMENTS 6,733,102 B2 5/2004 Hosono
6,827,418 B2 * 12/2004 Otokita ..... 347/19
6,834,925 B2 12/2004 Ikeda
2002/0051022 A1 * 5/2002 Hosono ..... 347/11

FOREIGN PATENT DOCUMENTS

| | | |
|---|---|---|
| JP | 2002-96528 | 4/2002 |
| JP | 2002-192714 | 7/2002 |
| JP | 2003-72055 | 3/2003 |
| JP | 2003-175654 | 6/2003 |

* cited by examiner

*Primary Examiner*—Julian D Huffman
(74) *Attorney, Agent, or Firm*—McDermott Will & Emery LLP

(57) ABSTRACT

An ink jet recording apparatus includes: a print head having an ink discharge port for discharging ink toward a recording medium, thereby performing printing on the recording medium; a recording medium thickness setting unit setting a thickness of the recording medium; a droplet amount setting unit setting an ink droplet amount depending on the recording medium thickness; and a droplet amount control unit controlling an amount of an ink droplet to be discharged from the ink discharge port to the set ink droplet amount.

17 Claims, 8 Drawing Sheets

FIG.7

DROPLET AMOUNT TABLE T1 FOR NORMAL GAP OF 1.4 mm

| PAPER TYPE | PAPER THICKNESS | PAPER THICKNESS UNIT: μm | DISTANCE BETWEEN HEAD AND PRINT SURFACE UNIT:mm | DROPLET AMOUNT UNIT:pl | | |
|---|---|---|---|---|---|---|
| | | | | SMALL | MIDDLE | LARGE |
| PLAIN PAPER | THIN | 90 | 1.31 | 3 | 5 | 10 |
| | THICK | 200 | 1.20 | 2 | 4 | 10 |
| GLOSSY PAPER | THIN | 225 | 1.27 | 3 | 5 | 10 |
| | THICK | 300 | 1.10 | 1.5 | 3 | 10 |

RESOLUTION: 1200×1200 dpi

DROPLET AMOUNT TABLE T2 FOR LARGE GAP OF 2mm

| DROPLET AMOUNT UNIT:pl |
|---|
| 10 |

METHOD OF CONTROLLING INK JET RECORDING APPARATUS

CROSS REFERENCE TO RELATED APPLICATION

This application claims priority from Japanese Patent Application No. 2006-27903 filed Feb. 6, 2006, the entire content of which is incorporated herein by reference.

TECHNICAL FIELD

The invention relates to a method of controlling an ink jet recording apparatus and an ink jet recording apparatus.

BACKGROUND

There is known an ink jet printer that repeats recording operation and feeding operation to thereby form an image on the recording medium. In the recording operation, ink is discharged toward a recording medium while a head for discharging ink is reciprocated in the main scanning direction. In the feeding operation, the recording medium is fed in the sub scanning direction.

A plurality of nozzles or ink discharge ports are formed in the head. The nozzles are for discharging ink in the feeding direction of the recording medium. Ink is discharged toward the recording medium from the nozzles.

Jpn. Pat. Appln. Laid-Open Publication No. 2003-72055 discloses an ink jet recording device that maintains constant the interval between the head and surface of the recording medium facing the head in order to prevent displacement of ink droplet impact point on the recording medium, which will occur since the recording medium is moved at a predetermined speed.

Further, Jpn. Pat. Appln. Laid-Open Publication No. 2002-96528 discloses an ink jet recording apparatus that detects the changeable interval between the head and platen and performs predetermined processing such as changing the ink droplets discharge timing to thereby obtain a satisfactory image.

SUMMARY

However, the apparatus of Jpn. Pat. Appln. Laid-Open Publication No. 2003-72055 has disadvantages in that a mechanism for maintaining constant the interval between the head and surface of the recording medium becomes complicated to result in higher cost. Further, in the case where a plain paper is used as the recording medium, adhesion of ink causes the paper to swell to cause cockling (phenomenon in which the paper surface undulates) with the result that the paper is brought into contact with the head to cause ink stain on the image or damage to the head.

Further, a user can arbitrarily adjust the head gap in the case of the apparatus of Jpn. Pat. Appln. Laid-Open Publication No. 2002-96528. However, in the case where a large head gap is set, if the size of ink droplets discharged from the ink discharge ports is relatively small, ink becomes a mist state and the ink may fly in various directions, resulting in a variation in the ink droplet impact point. The ink head is reciprocated in the main scanning direction while the recording medium is moved in the sub scanning direction, so that the air existing between the head and recording medium moves in a complex manner. In particular, a technique for discharging a very small ink droplet with an ink amount of about 1 pl (picoliter) has recently been developed to improve image quality, and the ink may fly by the air flow.

FIG. 1 is a view schematically showing the positional relationship between the head and plain paper placed on the platen. In this case, the head discharges ink while moving from the left to right of the illustration. In the case where the amount of ink to be discharged is relatively large, ink reaches the printing surface, depicting the trajectory as represented by b. On the other hand, in the case where the amount of ink to be discharged is relatively small, discharged ink reaches the printing surface, depicting the trajectory as represented by a or c due to complex movement of air around the head, which is caused by the reciprocating motion of the head and movement of the printing paper, resulting in a variation in the ink droplet impact point.

In view of the foregoing, it is an object of the invention to provide a method of controlling an ink jet recording apparatus by appropriately controlling the ink amounts of the discharged ink droplets and an ink jet recording apparatus that can appropriately control the ink amounts of the discharged ink droplets.

In order to attain the above and other objects, the invention provides an ink jet recording apparatus, including: a print head having an ink discharge port for discharging ink toward a recording medium, thereby performing printing on the recording medium; a recording medium thickness setting unit setting a thickness of the recording medium; a droplet amount setting unit setting an ink droplet amount depending on the recording medium thickness; and a droplet amount control unit controlling an amount of an ink droplet to be discharged from the ink discharge port to the set ink droplet amount.

According to another aspect, the invention provides a method for controlling an ink jet recording apparatus having a print head formed with an ink discharge port for discharging ink toward a recording medium and a controller controlling an ink amount of an ink droplet to be discharged from the ink discharge port, the method including: setting thickness of the recording medium; and setting an ink droplet amount depending on the recording medium thickness, the controller controlling the ink amount of an ink droplet to be discharged from the ink discharge port to the set ink droplet amount.

According to another aspect, the invention provides a storage medium storing a set of program instructions executable on a data processing device for controlling an ink jet recording apparatus having a print head formed with an ink discharge port for discharging ink toward a recording medium and a controller controlling an ink amount of an ink droplet to be discharged from the ink discharge port, the instructions including: setting thickness of the recording medium; and setting an ink droplet amount depending on the recording medium thickness, the controller controlling the ink amount of an ink droplet to be discharged from the ink discharge port to the set ink droplet amount.

BRIEF DESCRIPTION OF THE DRAWINGS

The particular features and advantages of the invention as well as other objects will become apparent from the following description taken in connection with the accompanying drawings, in which:

FIG. 7 shows an example of a droplet amount table for a normal gap that stores the ink droplet amount that changes in association with the paper thickness and the paper type and an example of another droplet amount table for a large gap that stores the ink droplet size that does not change irrespective of the paper thickness and the paper type.

DETAILED DESCRIPTION

Figure 1:
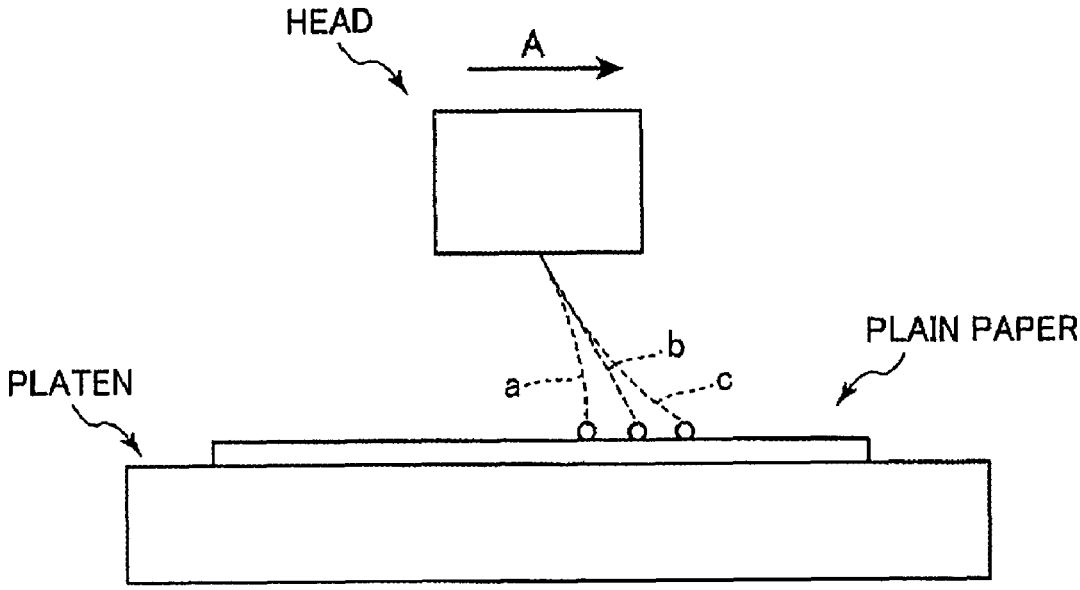
FIG. 1 is a view schematically showing a state where ink droplets are discharged toward the recording medium from the head.

A method of controlling an ink jet recording apparatus and an ink jet recording apparatus according to an embodiment of the invention will be described while referring to the accompanying drawings wherein like parts and components are designated by the same reference numerals to avoid duplicating description.

Figure 2:
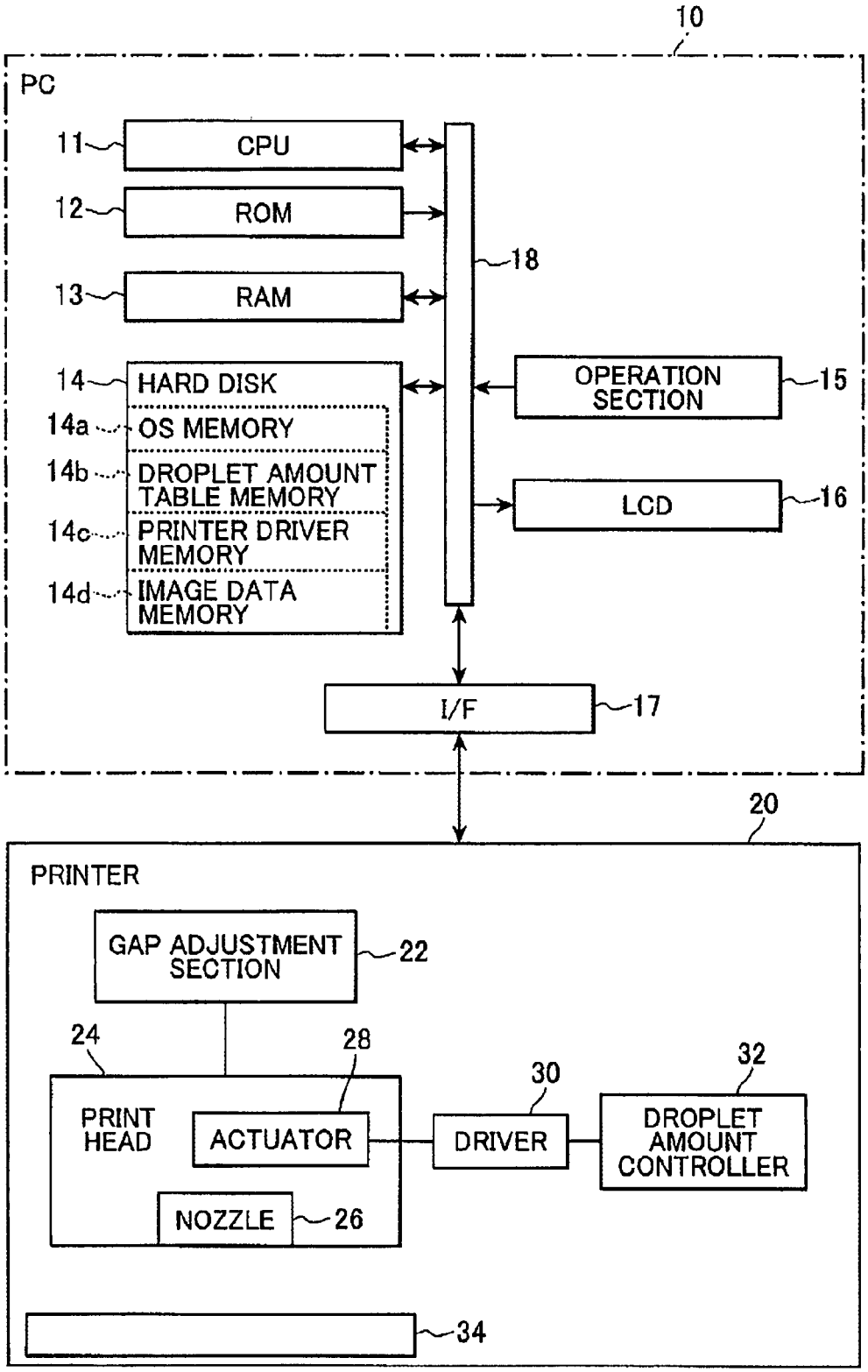
FIG. 2 is a block diagram showing an electrical configuration of a personal computer and a printer according to an embodiment of the present invention.

FIG. 2 is a block diagram showing an electrical configuration of a personal computer (hereinafter, referred to merely as "PC") 10 and a printer 20 connected to the PC 10. The PC 10 functions as an image processor for controlling the printer 20 to serve as an ink jet recording apparatus.

The PC 10 includes a CPU 11, an ROM 12, an RAM 13, a hard disk drive (hereinafter, referred to as "HDD") 14, an operation section 15, an LCD (Liquid Crystal Display) 16 serving as a display unit, and a printer interface (hereinafter, referred to as "I/F") 17. These components are connected to each other by a bus 18.

The CPU 11 is a calculation unit. The CPU 11 executes programs stored in the ROM 12, RAM 13, and HDD 14. The ROM 12 is a read-only memory that stores a basic program such as a boot program.

The RAM 13 is a rewritable memory. The RAM 13 stores data that needs to be temporarily stored in processing performed by the CPU 11. When an application program or printer driver stored in the HDD 14 is executed, the application or driver is transferred to the RAM 13.

The HDD 14 is a rewritable memory. The HDD 14 includes an OS memory 14*a* that stores an operating system executed on the PC 10, a droplet amount table memory 14*b* that stores droplet amount tables T1 and T2 shown in FIG. 7 that are referred to when a printer driver performs halftone processing, a printer driver memory 14*c* that stores the printer driver, and an image data memory 14*d* that stores image data.

The printer driver includes a program whose flowchart will be described with reference to FIG. 8. The printer driver may be originally stored in a data recording medium, such as a CD-ROM, and is stored in the HDD 14 from the data recording medium. Or, the printer driver may be downloaded to the HDD 14 from a network such as the Internet.

The printer 20 includes a print head 24, a platen 34, a head moving mechanism (not shown), and a recording paper conveying mechanism (not shown). The platen 34 is fixedly provided in the housing (not shown) of the printer 20. The head moving mechanism moves the print head 24 in a main scanning direction relative to the platen 34. The recording paper conveying mechanism conveys a recording paper on the platen 34 in a sub scanning direction that is perpendicular to the main scanning direction. The print head 24 includes: a plurality of nozzles 26 for ejecting ink droplets in a direction toward the platen 34; and an actuator 28 for actuating the nozzles 26 to eject ink droplets therefrom. The printer 20 further includes a gap adjustment section 22, a driver 30, and a droplet amount controller 32. The gap adjustment section 22 adjusts the gap (head gap) between the print head 24 and the platen 34. The driver 30 generates a drive signal of a waveform for driving the actuator 28. The droplet amount controller 32 controls the driver 30 to change the waveform of the drive signal, thereby controlling the ink amounts of the ink droplets.

Figure 3:
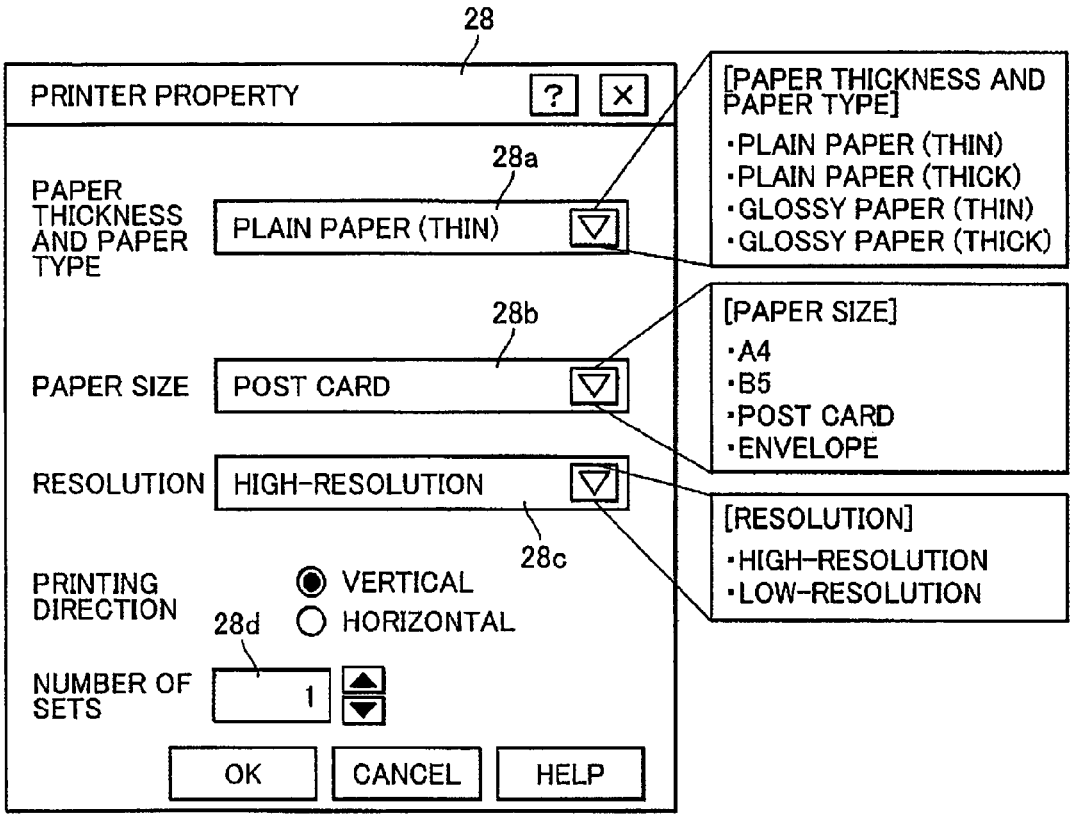
FIG. 3 is a view showing a printer property setting window displayed on a display unit.

Various setting items made in the printer driver processing will next be described with reference to FIG. 3. FIG. 3 shows a property setting window 28 displayed on the LCD 16 when a user selects print property setting in the printer driver processing.

Displayed on the property setting window 28 are a paper type/thickness selection box 28*a* for selecting the type and thickness of a printing paper which is a recording medium on which an image is printed, a paper size setting box 28*b* for selecting the size of a printing paper, a resolution setting box 28*c* for setting the resolution of an image to be printed, and a number-of-sets setting box 28*d* for setting the number of sets to be printed.

The paper type/thickness selection box 28*a* has a display area for displaying a selected paper type/thickness and an icon (a down-facing triangle) at the right end of the display area. When a user operates a mouse to point a cursor to the icon and clicks the mouse, a pull-down menu is displayed as also shown in FIG. 3. Then, when the user moves the cursor to any item on the displayed pull-down menu, the item indicated by the cursor is selected.

In the present embodiment, as the type/thickness of a printing paper, the user can select either thin plain paper, thick plain paper, thin glossy paper, or thick glossy paper. Similarly, the paper size setting box 28*b* has a display area for displaying a selected paper size and an icon for expanding a pull-down menu for item selection. The user can select the print paper size among A4, B5, postcard, and envelope.

The resolution setting box 28*c* has also an area for displaying a selected resolution and an icon for expanding a pull-down menu for item selection. The user can select either high-resolution or low-resolution. High-resolution is, e.g., 1200×1200 dpi, and low resolution is, e.g., 600×600 dpi. The ink droplet amount, that is, the amount of ink used to form each ink droplet differs depending on the selected resolution.

The number-of-sets setting box 28*d* has an area for displaying the determined number of sets by a numeric value. On the right side of this area, an increment icon (an up-facing triangle) for incrementing the numerical value and a decrement icon (down-facing triangle) for decrementing the numerical value are arranged vertically. When the user operates a mouse to move a cursor to these icons and click the mouse, the number of sets to be printed can be set. As a matter of course, a numerical keypad can be used to directly input the number of sets.

Figure 4B:
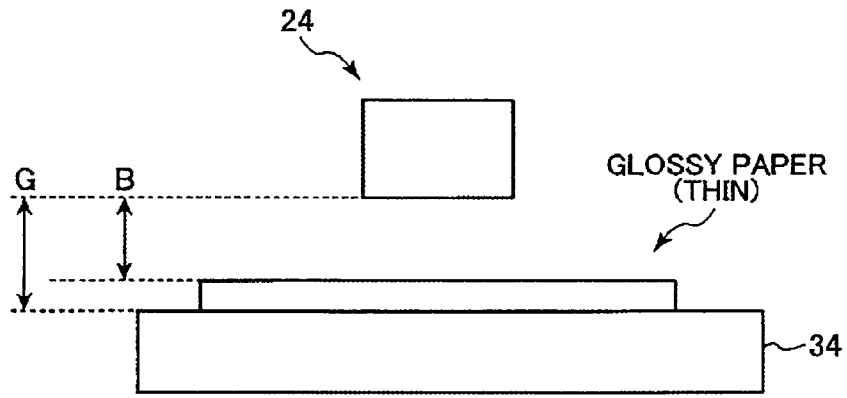
FIGS. 4(*a*) and 4(*b*) are conceptual views showing the positional relationship between a paper placed on a platen and a head, wherein FIG. 4(*a*) shows a case where a plain thin paper is used while FIG. 4(*b*) shows a case where a thin glossy paper is used.
Figure 4A:
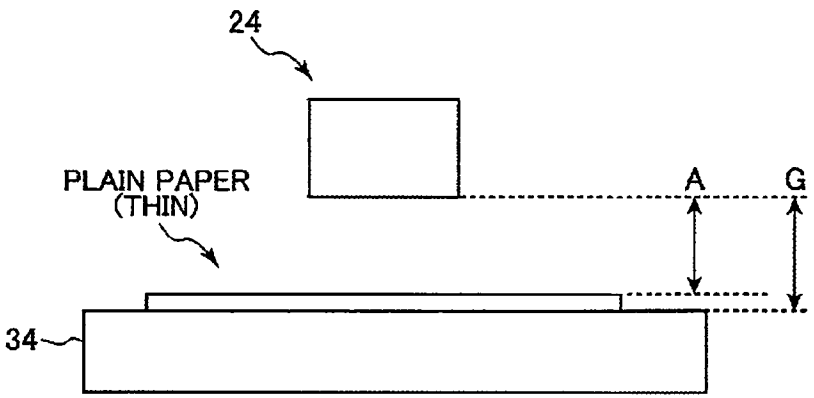

Next, the interval between the print head 24 and the surface of the recording paper will be described with reference to FIGS. 4(*a*) and 4(*b*). FIGS. 4(*a*) and 4(*b*) show the case where the interval between the upper surface of the platen 34 and lower surface of the print head 24 where the nozzles 26 are formed is set to G. In the case where a thin plain paper is selected as a printing paper, as shown in FIG. 4(*a*), the interval between the upper surface (printing surface) of the thin plain paper and the print head 24 becomes A which is a value obtained by subtracting the thickness of the thin plain paper from the interval G.

In the case where a thin glossy paper is selected as a printing paper, when the thin glossy paper is placed on the upper surface of the platen 34, as shown in FIG. 4(*b*), the interval between the upper surface (printing surface) of the thin glossy paper and the print head 24 becomes B which is a value obtained by subtracting the thickness of the thin glossy paper from the interval G.

In general, the thickness of the thin plain paper is about 90 μm (micrometer) and thickness of the thin glossy paper is 225 μm, so that the interval A is larger than the interval B. Accordingly, when printing is performed on the thin plain paper, the interval between the print head lower surface and printing surface becomes comparatively large. Air moves in this large gap between the head and the printing paper, and therefore the ink droplet impact point varies for small-size ink droplets. In the case where the printing paper is an envelope, the thickness thereof is 210 to 260 μm, and therefore the interval between the print head 24 and printing surface becomes comparatively small.

Figure 5B:
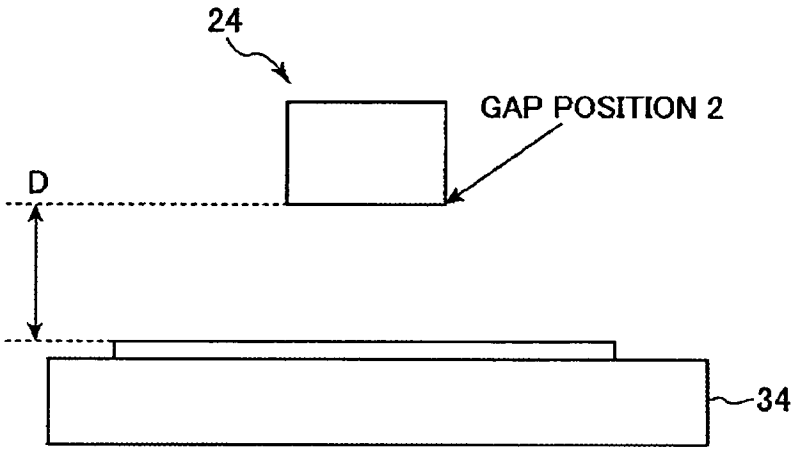
FIGS. 5(*a*) and 5(*b*) are conceptual views showing the positional relationship between a paper placed on the platen and head, wherein FIG. 5(*a*) shows a case where the head is shifted to a lower position while FIG. 5(*b*) shows a case where the head is shifted to a higher level.
Figure 5A:
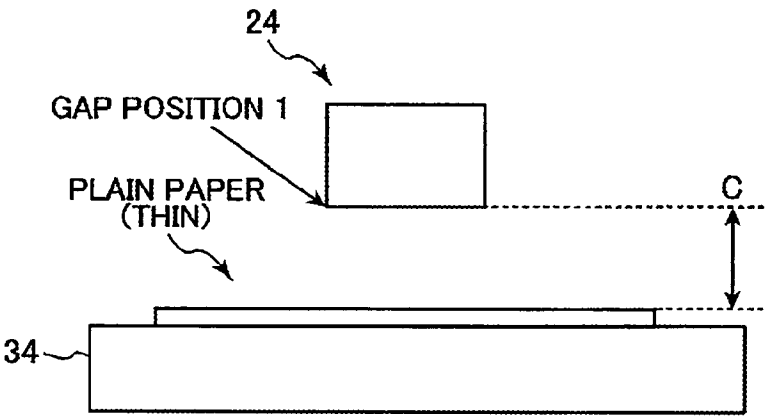

FIGS. 5(*a*) and 5(*b*) are views showing the case where the vertical position of the head is changed. In this embodiment, the vertical position of the print head 24 is controlled by the gap adjustment section 22.

FIG. 5(*a*) shows a case where the head 24 is shifted to a lower position (gap position 1). In this case, the interval between the print head lower surface and printing surface of the thin plain paper becomes C. FIG. 5(*b*) shows a case where the print head 24 is shifted to a higher position (gap position 2). In this case, the interval between the head lower surface and printing surface of the thin plain paper becomes D. The interval D is larger than the interval C.

Figure 6B:
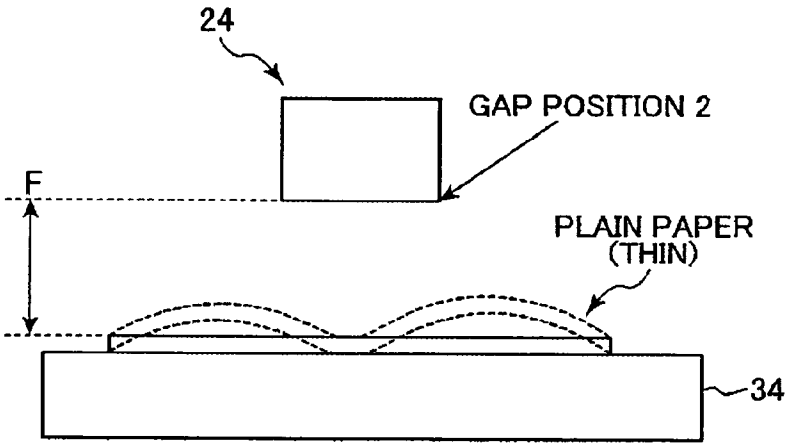
FIGS. 6(*a*) and 6(*b*) are conceptual views showing the positional relationship between a paper placed on the platen and head, wherein FIG. 6(*a*) shows a case where a thin glossy paper is used while FIG. 6(*b*) shows a case where a thin plain paper is used.
Figure 6A:
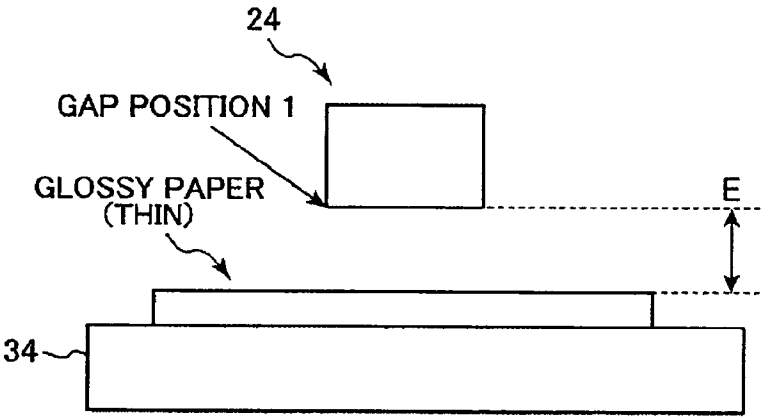

As is the case with FIGS. 4(*a*) and 4(*b*), FIGS. 6(*a*) and 6(*b*) compare a case where the thin glossy paper is used and case where the thin plain paper is used. Cockling of a small degree occurs in the glossy paper. Cockling of a larger degree occurs in the plain paper in comparison with the glossy paper. Therefore, the interval between the head 24 and thin plain paper needs to be set larger. FIG. 6(*a*) shows a state where a thin glossy paper is placed on the platen 34 and the interval between the head lower surface and printing surface is set to E. FIG. 6(*b*) shows a state where a thin plain paper is placed on the platen 34 and the interval between the head lower surface and printing surface is set to F which is a value obtained when cockling does not occur. As shown in dotted curves in FIG. 6(*b*), cockling easily occurs in the plain paper due to absorption of ink into the paper, so that the head 24 needs to be shifted to a higher position.

It is noted that the interval (head gap) between the head lower surface and platen upper surface can be set to either one of a normal gap of 1.4 mm and a large gap of 2 mm.

A plurality of pairs of droplet amount tables T1 and T2 for setting the ink droplet amounts are stored in the droplet amount table memory 14*b*. A pair of droplet amount tables T1 and T2 is stored for each resolution. FIG. 7 shows an example of the pair of droplet amount tables T1 and T2 for the resolution of 1200×1200 dpi. One pair of droplet amount tables T1 and T2 for each resolution include a droplet amount table T1 for the normal head gap of 1.4 mm and another droplet amount table T2 for the large head gap of 2 mm.

In the droplet amount table T1, the "distance between head and print surface" is a value obtained by subtracting the paper thickness from the normal gap of 1.4 mm between the head 24 and the platen 34.

In the present embodiment, three ink droplet sizes: small-dot, middle-dot, and large-dot are used to perform printing in so-called halftone processing. As shown in FIG. 7, the droplet amount table T1 for the normal gap stores therein twelve values of ink droplet amounts for the three ink droplet sizes in association with the four pairs of the thickness and the type of the printing papers.

For example, as apparent from FIG. 7, 3 pl (small-dot), 5 pl (middle-dot), and 10 pl (large-dot) are set for the thin plain paper, while 1.5 pl (small-dot), 3 pl (middle-dot), and 10 pl (large-dot) are set for the thick glossy paper. As to the large-dot, the ink droplet amount is set to the same largest value (10 pl) for all of the thin plain, thick plain, thin glossy, and thick glossy papers. As to the middle-dot and small-dot, the ink droplet size is set larger for the thinner papers, and is set larger for the plain papers than for the glossy papers.

To the contrary, in the droplet amount table T2 for the large gap, the ink droplet amount of the largest value of 10 pl that is used for the large-dot in the droplet amount table T2 for the normal gap is set for all of the ink droplet sizes of small-dot, middle-dot, and large-dot irrespective of the thickness and type of the printing papers.

Next, processing executed by the printer driver will be described with reference to FIG. 8.

Figure 8:
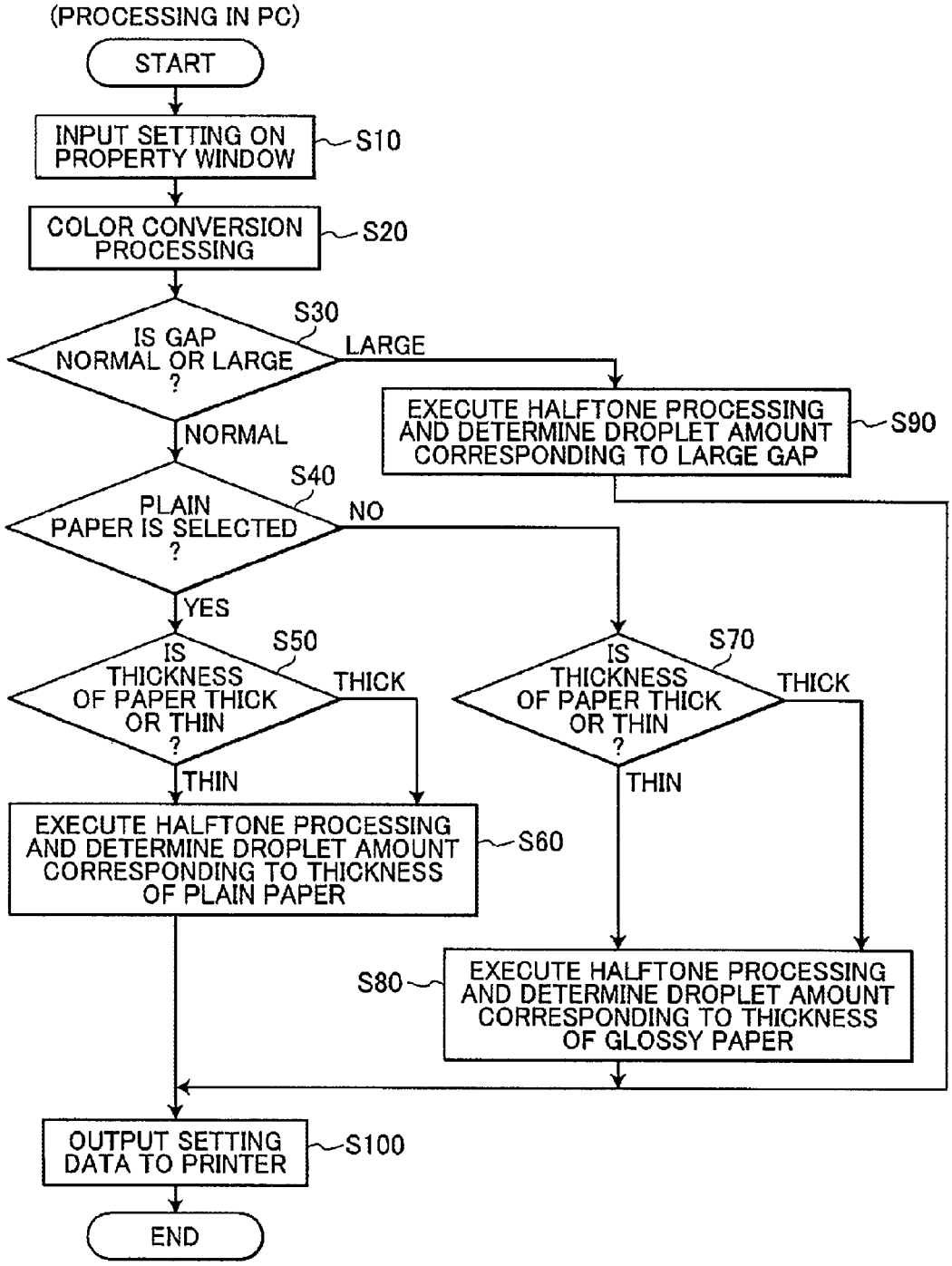
FIG. 8 is a flowchart showing processing executed in the PC of FIG. 2.

FIG. 8 is a flowchart showing the processing executed by the printer driver.

The printer driver firstly displays the printer property window shown in FIG. 3 to allow a user to set paper thickness, paper type, paper size, and resolution (S10).

Then, color conversion processing is performed for an image to be printed (S20). In this color conversion processing, RGB (Red, Green, Blue) values constituting an input image are converted into CMYK values (Cyan, Magenta, Yellow, Black) for printing. Although detailed description is omitted here, before the color conversion processing, an optimum profile for a selected paper type is selected and, based on the selected profile, profile conversion is performed for the image data.

Then, whether the head gap should be the normal gap or the large gap is determined based on the paper thickness, paper type, and paper size that have been set in S10 (S30).

When the head gap is the normal gap, whether the paper type selected in S10 is a plain paper or not is further determined (S40).

In the case where the plain paper has been selected (S40: Yes), whether the paper thickness selected in S10 is thin or thick is determined (S50).

The halftone processing is then performed (S60). That is, the size of each CMYK ink droplet for each pixel is set to either one of: small, middle, large, and none through a dither method or an error diffusion method. The ink amount for the ink droplet of the determined size is set based on the thickness of the plain paper while referring to the ink droplet amount table T1 for the normal gap shown in FIG. 7.

On the other hand, in the case where not the plain paper but the glossy paper has been selected (S40: No), whether the paper thickness selected in S10 is thin or thick is determined (S70). Then, the halftone processing is performed to set the size of each CMYK ink droplet for each pixel to either small, middle, large, or none, and to set the ink amount for the ink droplet of the determined size based on the thickness of the glossy paper with reference to the ink droplet amount table T1 for the normal gap (S80).

On the other hand, when the head gap is the large gap, the halftone processing is performed and the largest droplet amount of 10 pl is set for all of the small, middle, and large ink droplets with reference to the ink droplet amount table T2 for the large gap (S90). So, in the case where the interval between the nozzles 26 and the surface of the recording medium becomes large, the ink droplet amount can be prevented from being set smaller than 10 pl. This keeps the ink droplet impact point on the recording medium constant and prevents image distortion which will be caused by displacement of the ink droplet impact point, thereby achieving clear and high-quality image printing.

After the setting has been made in the halftone processing in S60, S80, or S90, the setting data is output to the printer 20 (S100). In the printer 20, the gap adjustment section 22 sets the head gap to the gap (normal or large) determined in S30, and the droplet amount controller 32 controls the driver 30 to drive the actuator 28 to actuate the head 24 to eject ink droplets of the determined sizes with the determined ink droplet amounts.

As described above, when the paper type and the paper thickness have been set, the printer driver sets the ink droplet amount depending on the set paper thickness and paper type. Thus, in the case where the thin plain paper is selected, the interval between the head 24 and surface of the printing paper placed on the platen 34 is large. The problem accompanied by the cockling will not occur. By setting the ink droplet amount comparatively large, it is possible to prevent a variation in the ink droplet impact point.

Further, in the case where a thick glossy paper is selected, the interval between the head 24 and surface of the printing paper placed on the platen 34 is small. Cockling of a small degree occurs on the glossy paper. So, even though the ink droplet amount is set comparatively small, variation in the ink droplet impact point can be prevented, thereby achieving the high-quality image printing.

While the invention has been described in detail with reference to the embodiment thereof, it would be apparent to those skilled in the art that various changes and modifications may be made therein without departing from the spirit of the invention.

For example, in the above embodiment, settings of the ink droplet amounts are made on the printer driver on the PC 10 side. However, the printer 20 may be modified to have the electrical configuration the same as those shown in FIG. 2 and to perform settings of the ink droplet amounts in the same manner as described above with reference to FIG. 8. For example, the printer 20 may be modified so as to be capable of receiving a data storing medium directly attached thereto, and of printing image data stored in the data recording medium.

The printer 20 may be modified to print only on a single type of recording paper. For example, the printer 20 may be modified to print only on plain paper. In such a case, it is sufficient that the user selects only the thickness of the printing paper. The paper type/thickness selection box 28*a* on the printer property window of FIG. 3 is modified to select only the thickness of the printing paper. The ink droplet amount table T1 for the normal gap shown in FIG. 7 is modified to include rows only for the plain paper. In FIG. 8, the process of S40, S70, and S80 may be omitted, and the process of S60 is modified to perform the halftone processing and to set the droplet amounts for the small, middle, and large ink droplets based on the thickness of the printing paper.

The paper size is set by the user on the display window in the above embodiment. Alternatively, the printer 20 may be provided with a paper feeding apparatus for feeding a paper by using a guide plate. The user can adjust the guide plate to the size of the paper stacked. In such a case, the adjusted position of the guide plate may be detected to identify the paper type. For example, the printer 20 may determine that the stacked papers are plain papers or glossy papers when the A4 size is detected, and may determine that the stacked papers are envelops when the envelop size is detected.

What is claimed is:

1. An ink jet recording apparatus, comprising:

a print head having an ink discharge port for discharging ink toward a recording medium, thereby performing printing on the recording medium;

a recording medium thickness setting unit configured to set a thickness of the recording medium;

a droplet amount setting unit configured to set an ink droplet amount according to a predetermined relationship between the recording medium thickness and the ink droplet amount, the relationship being pre-stored in the ink jet recording apparatus; and a droplet amount control unit configured to control an amount of an ink droplet to be discharged from the ink discharge port to the ink droplet amount.

2. The ink jet recording apparatus according to claim 1, further comprising a recording medium type setting unit configured to set a type of the recording medium by a user input, the droplet amount setting unit being configured to set the ink droplet amount depending on both of the thickness of the recording medium and the type of the recording medium.

3. The ink jet recording apparatus according to claim 2, further comprising a first droplet amount storage unit configured to store a plurality of values of ink droplet amounts in association with a plurality of combinations of values for the recording medium thickness and recording medium types, and wherein the droplet amount setting unit is configured to select one value of the ink droplet amount from the droplet amount storage unit depending on a combination of the recording medium thickness set by the recording medium thickness setting unit and the type of the recording medium set by the recording medium type setting unit, to thereby set the ink droplet amount.

4. The ink jet recording apparatus according to claim 3, wherein the first droplet amount storage unit is configured to store a plurality of groups of ink droplet amount values in association with the plurality of combinations of the values for the recording medium thickness and the recording medium types, each group of ink droplet amount values including a plurality of values of ink droplet amounts which correspond to a plurality of different sized dot states, respectively, and which are different from one another, and wherein the droplet amount setting unit includes a first droplet amount setting unit that includes:

a group selecting unit configured to select one group of ink droplet amount values from the first droplet amount storage unit, depending on a combination of the recording medium thickness set by the recording medium thickness setting unit and the recording medium type set by the recording medium type setting unit; and a first halftone processing unit configured to set, for each pixel in an image desired to be recorded, one of a non-dot state and a plurality of different sized dot states and that sets, to each dot state set pixel to which one of the plurality of dot states is set, an ink droplet amount value that is included in the selected group of ink droplet amount values and that corresponds to the dot state.

5. The ink jet recording apparatus according to claim 4, wherein a largest value among the plurality of values of ink droplet amounts included in each group of ink droplet amount values stored in the first droplet amount storage unit is equal to a predetermined maximum ink amount value, wherein the ink jet recording apparatus further comprises:

a second droplet amount storage unit configured to store a single ink droplet amount value that is equal to the predetermined maximum ink amount value; and a gap setting unit configured to set an interval between the print head and a platen, on which the recording medium is disposed, by selecting one of first and second predetermined values of interval, the second predetermined value of interval being greater than the first predetermined value of interval, wherein the droplet amount setting unit includes a second droplet amount setting unit that includes:

a droplet amount reading unit configured to read the single ink droplet amount value from the second droplet amount storage unit; and a second halftone processing unit configured to set, for each pixel in the image desired to be recorded, one of the non-dot state and the plurality of different sized dot states and set, to each dot state set pixel to which one of the plurality of dot states is set, the single ink droplet amount value that is read from the second droplet amount storage unit, wherein when the gap setting unit sets the interval to the first predetermined value, the first droplet amount setting unit operates to set an ink droplet amount to each dot-state set pixel dependently on the recording medium thickness set by the recording medium thickness setting unit, the recording medium type set by the recording medium type setting unit, and the dot state set to the each dot-state set pixel, and wherein when the gap setting unit sets the interval to the second predetermined value, the second droplet amount setting unit operates to set the single ink droplet amount to each dot-state set pixel, irrespective of the recording medium thickness set by the recording medium thickness setting unit, irrespective of the recording medium type set by the recording medium type setting unit, and irrespective of the dot state set to the each dot-state set pixel.

6. The ink jet recording apparatus according to claim 1, further comprising a droplet amount storage unit configured to store a plurality of values of ink droplet amounts in association with a plurality of values for the recording medium thickness, and wherein the droplet amount setting unit is configured to select one value of the ink droplet amount from the droplet amount storage unit depending on the recording medium thickness, to thereby set the ink droplet amount.

7. The ink jet recording apparatus according to claim 6, further comprising a gap setting unit configured to set an interval between the print head and a platen on which the recording medium is disposed, and wherein the droplet amount setting unit is configured to set the ink droplet amount depending on the interval and the recording medium thickness.

8. The ink jet recording apparatus according to claim 7, wherein the gap setting unit is configured to set the value of the interval by selecting one of two different predetermined values, and wherein the droplet amount setting unit is configured to set the ink droplet amount by selecting the largest ink droplet amount from among the plurality of ink droplet amounts when the gap setting unit sets the interval to a larger one of the two different predetermined values.

9. The ink jet recording apparatus according to claim 1, wherein the recording medium thickness is set by a user input.

10. A method for controlling an ink jet recording apparatus having a print head formed with an ink discharge port for discharging ink toward a recording medium and a controller controlling an ink amount of an ink droplet to be discharged from the ink discharge port, the method comprising:

setting thickness of the recording medium; and setting an ink droplet amount according to a predetermined relationship between the recording medium thickness and the ink amount, the relationship being pre-stored in the ink jet recording apparatus, the controller controlling the ink amount of an ink droplet to be discharged from the ink discharge port to the ink droplet amount.

11. The method according to claim 10, further comprising a step of enabling a user to set the type of the recording medium, wherein the ink droplet amount is set depending on both of the thickness of the recording medium and the type of the recording medium.

12. The method according to claim 10, wherein one value is selected among a plurality of values of ink droplet amounts that are stored in association with a plurality of values for the recording medium thickness, to thereby set the ink droplet amount.

13. The method according to claim 12, further comprising setting an interval between the print head and a platen on which the recording medium is disposed, and wherein the ink droplet amount is set depending on the interval and the recording medium thickness.

14. The method according to claim 13, the value of the interval is set by selecting one of two different predetermined values, and wherein the ink droplet amount is set by selecting a largest ink droplet amount from among the plurality of ink droplet amounts when the interval is set to a larger one of the two different predetermined values.

15. The method according to claim 10, wherein the thickness of the recording medium is set by a user input.

16. A storage medium storing a set of program instructions executable on a data processing device for controlling an ink jet recording apparatus having a print head formed with an ink discharge port for discharging ink toward a recording medium and a controller controlling an ink amount of an ink droplet to be discharged from the ink discharge port, the instructions comprising:

setting a thickness of the recording medium; and setting an ink droplet amount according to a predetermined relationship between the recording medium thickness and the ink amount, the relationship being pre-stored in the ink jet recording apparatus, the controller controlling the ink amount of an ink droplet to be discharged from the ink discharge port to the ink droplet amount.

17. The storage medium according to claim 16, wherein the thickness of the recording medium is set by a user input.

* * * * *